US009988175B2

(12) United States Patent
Hasan et al.

(10) Patent No.: US 9,988,175 B2
(45) Date of Patent: Jun. 5, 2018

(54) SECTIONED CORRUGATED SLEEVE FOR THERMAL GEL PACKS

(71) Applicant: Lifoam Industries, LLC, Hunt Valley, MD (US)

(72) Inventors: Mahmudul Hasan, Mississauga (CA); Casey E. Coleman, Jr., Rutledge, GA (US)

(73) Assignee: Lifoam Industries, LLC, Boca Raton, FL (US)

( * ) Notice: Subject to any disclaimer, the term of this patent is extended or adjusted under 35 U.S.C. 154(b) by 153 days.

(21) Appl. No.: 15/208,832

(22) Filed: Jul. 13, 2016

(65) Prior Publication Data

US 2017/0015461 A1 Jan. 19, 2017

Related U.S. Application Data

(60) Provisional application No. 62/192,041, filed on Jul. 13, 2015.

(51) Int. Cl.

| | |
|---|---|
| ***B65D 5/4805*** | (2006.01) |
| ***B65D 5/02*** | (2006.01) |
| ***B65D 5/66*** | (2006.01) |
| ***B65D 5/48*** | (2006.01) |
| ***B65D 5/50*** | (2006.01) |

(52) U.S. Cl.

CPC ..... *B65D 5/0254* (2013.01); *B65D 5/48014* (2013.01); *B65D 5/48018* (2013.01); *B65D 5/5016* (2013.01); *B65D 5/6658* (2013.01); *F25D 2303/0822* (2013.01)

(58) Field of Classification Search

CPC .... B65D 5/48; B65D 5/0254; B65D 5/48014; B65D 5/5016; B65D 5/6658; B65D 5/4805; B65D 5/48018

USPC ..... 229/939, 120.02, 120.08

See application file for complete search history.

(56) References Cited

U.S. PATENT DOCUMENTS

| | | | | |
|---|---|---|---|---|
| 1,843,038 A | | 1/1932 | McIlvain | |
| 2,330,345 A | * | 9/1943 | Elliott | B65D 71/72 206/419 |
| 2,335,366 A | * | 11/1943 | Stearn | B65D 5/48008 206/392 |
| 3,114,474 A | * | 12/1963 | Davis | B65D 5/5445 206/419 |
| 3,429,499 A | * | 2/1969 | Olsen | B65D 5/48018 229/120.03 |

(Continued)

FOREIGN PATENT DOCUMENTS

WO 2013144621 A2 10/2013

*Primary Examiner* — Justin Larson

(74) *Attorney, Agent, or Firm* — Eversheds Sutherland (US) LLP

(57) ABSTRACT

A corrugated sleeve comprising an upper panel forming the top of the sleeve, a lower panel forming the bottom of the sleeve, at least two height panels forming the front and back of the sleeve, respectively, and at least two side panels forming the left and right of the sleeve, respectively. The upper, lower, height, and side panels thereby form the external structure of the sleeve. The sleeve may also include at least one pack assembly which extends from one of the panels, and for example from the end height panel. Each pack assembly may include at least one pack divider, which can be positioned between adjacent thermal packs when such thermal packs are contained within the sleeve.

17 Claims, 4 Drawing Sheets

(56) References Cited

U.S. PATENT DOCUMENTS 3,731,870 A * 5/1973 Buttery ..... B65D 5/48014 229/120.03
3,744,703 A * 7/1973 Mortenson ..... B65D 5/48018 206/387.1
3,780,931 A * 12/1973 Hanson ..... B65D 5/48014 229/120.08
3,804,321 A * 4/1974 Forbes, Jr. ..... B65D 5/5016 206/216
4,103,770 A * 8/1978 Brandenburger ..... B65D 71/36 206/193
4,274,579 A * 6/1981 Kulig ..... B65D 71/72 229/120.08
4,294,397 A * 10/1981 Kohler ..... B65D 5/48014 206/216
4,328,922 A * 5/1982 Hirata ..... B65D 5/5016 206/427
4,342,417 A * 8/1982 Forbes, Jr. ..... B65D 5/48014 229/120.08
4,349,105 A * 9/1982 Bradley ..... B65D 5/5021 206/317
4,458,837 A * 7/1984 Sellors ..... B65D 5/48004 229/120.08
4,694,987 A * 9/1987 Forbes, Jr. ..... B65D 5/48002 229/114
4,757,937 A * 7/1988 Maio ..... B65D 5/3635 206/562
7,004,314 B2 * 2/2006 Pucillo ..... B65D 5/2057 206/217
7,036,716 B2 * 5/2006 Kanamori ..... B65D 5/48018 206/738
9,004,278 B2 * 4/2015 Monti ..... B65D 5/4801 206/427
2001/0015178 A1 8/2001 LaRosa
2006/0097032 A1 * 5/2006 Kanamori ..... B65D 5/48018 229/120.21
2011/0100868 A1 5/2011 Lantz
2011/0248038 A1 10/2011 Mayer
2012/0072046 A1 3/2012 Tattam
2017/0015461 A1 * 1/2017 Hasan ..... B65D 5/0254
2017/0305650 A1 * 10/2017 Coulter ..... B65D 85/34

* cited by examiner

SECTIONED CORRUGATED SLEEVE FOR THERMAL GEL PACKS

CROSS REFERENCE TO RELATED APPLICATION

The present application claims priority to U.S. Provisional Patent Application No. 62/192,041, filed Jul. 13, 2015 titled SECTIONED CORRUGATED SLEEVE FOR A BOX, the entirety of which is hereby incorporated by reference.

BACKGROUND OF THE INVENTION

The present invention generally relates to a sectioned corrugated sleeve for a box. More specifically, the present invention relates to a corrugated thermal pack sleeve with integrated sections for supporting one or more thermal packs within the sleeve during storage or shipment.

When shipping or storing certain products, it is often desirable to maintain certain temperatures within a box. Thermal packs, such as gel packs that can achieve and maintain a desired temperature for a period of time, are often inserted into boxes for shipping or storage. Prior art sleeves exist for retaining such thermal packs, and are often corrugated like the boxes in which they are designed to reside. Such prior art sleeves are generally constructed as standard rectangular boxes, and are taped shut. When frozen, thermal packs generally retain their shape and therefore remain properly positioned within prior art sleeves.

However, during shipment or storage, thermal packs may have sufficient time to thaw. Upon thawing, thermal packs may not be able to retain their shape. When positioned within a prior art sleeve, one or more thawed thermal packs may shift during shipment, or generally when being moved. Such shifting may cause multiple thermal packs to bunch at one area of the prior art sleeve, and may result in bulging or bending of the prior art sleeve. Additionally, shifting of the thermal packs may result in uneven temperatures within the box.

Therefore, a thermal pack sleeve design is needed.

SUMMARY OF THE PRESENT INVENTION

In one embodiment a sectioned corrugated sleeve may include an upper panel forming the top of the sleeve, a lower panel forming the bottom of the sleeve, at least two height panels forming the front and back of the sleeve, respectively, and at least two side panels forming the left and right of the sleeve, respectively. The upper, lower, height, and side panels thereby form the external structure of the sleeve. The sleeve may also include at least one pack assembly which extends from one of the panels, and for example from the end height panel. Each pack assembly may include at least one pack divider, which can be positioned between adjacent thermal packs when such thermal packs are contained within the sleeve.

The upper panel may extend from a top side of said back height panel, and the lower panel may extend from a bottom side of said back height panel. The front height panel may extend from a side of said lower panel opposite said back height panel, and the side panel may extend from opposing left and right sides at least one of said upper and lower panels. At least one pack assembly may extend from a side of the front height panel opposite the lower panel.

In an example embodiment, the pack assembly may be a middle pack assembly that includes a center pack cover having opposing sides, two pack dividers with one extending from each of the opposing sides of the center pack cover, and at least one center pack tabs extending from each pack divider in opposing directions. Alternatively, the pack assembly may include two end pack assemblies. Each end pack assembly may include an end pack cover having opposing sides, and the end pack cover may extend from the front height panel. A pack divider may also extend from one side of the end pack cover opposite the front height panel, and an end pack tab may extend from the pack divider opposite the end pack cover. In another example embodiment, the corrugated sleeve of claim 1 wherein said at least one pack assembly includes two end pack assemblies and at least one middle pack assembly.

In some embodiments, at least one tab may extend from the upper panel opposite the back height panel. The tab may be sized to be received within a gap between the front height panel on one side and the pack divider and end pack tab the other side.

The number of pack assemblies may be [(N−1)/2], in an example embodiment, where N is the number of thermal packs housed by the corrugated sleeve, and N is an odd integer ≥3. In this embodiment, each pack assembly is a middle pack assembly. Alternatively, the number of pack assemblies may be [(N+1)/2], where N is the number of thermal packs housed by said corrugated sleeve, and N is an odd integer ≥3. In this embodiment, two of the N pack assemblies are end pack assemblies, and (N−2) of the pack assemblies are middle pack assemblies.

Figure 1A:
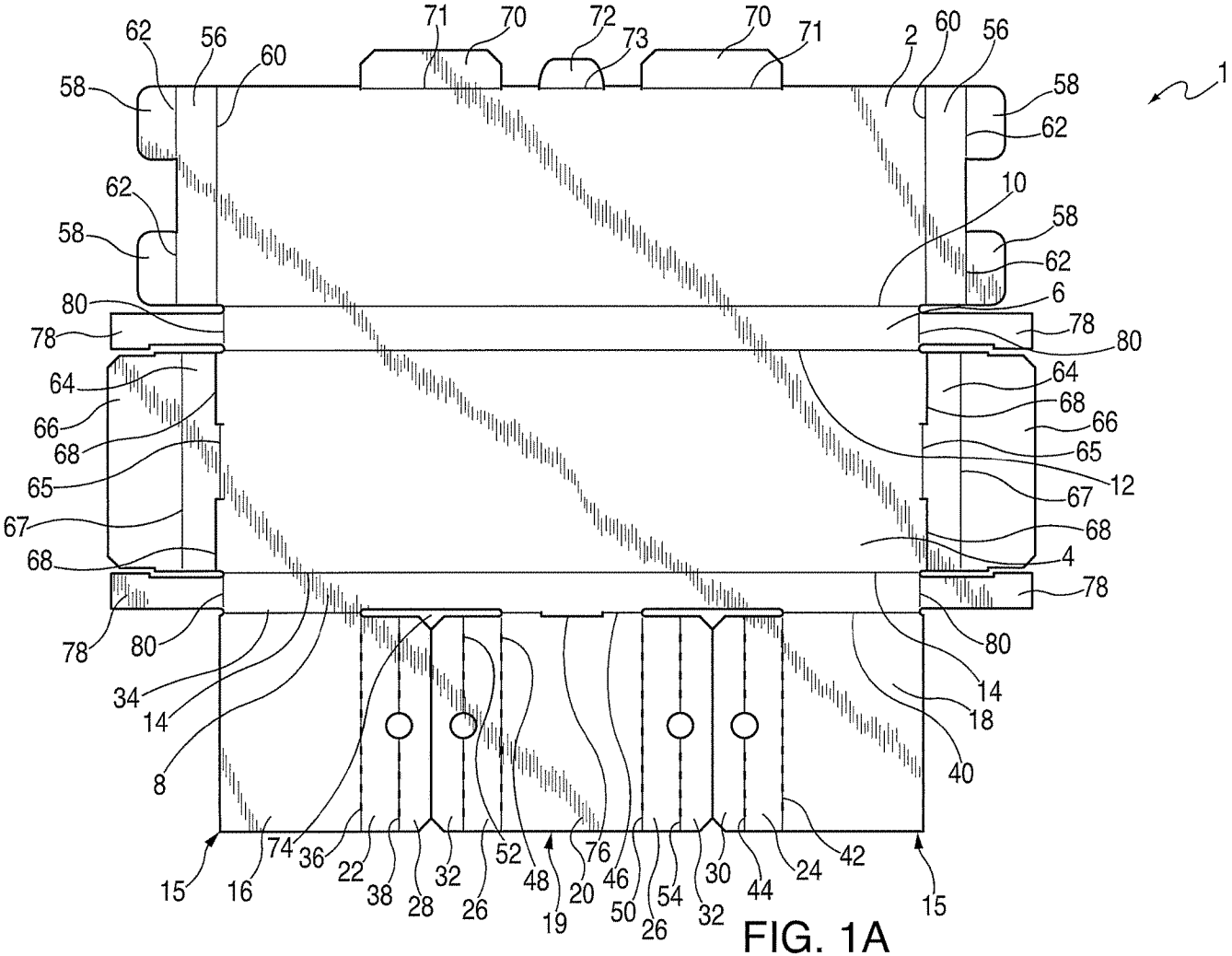
FIG. 1A illustrates an example embodiment of a sectioned corrugated sleeve for retaining five thermal packs, in its unfolded state.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

DETAILED DESCRIPTION OF THE DRAWINGS

FIG. 1A illustrates an example embodiment of a section corrugated sleeve 1 in its unfolded state. As can be seen, the sleeve 1 may include an upper panel 2, a lower panel 4, a center height panel 6, and an end height panel 8. As will be understood, the upper and lower panels 2 and 4 form the top and bottom of the sleeve 1, respectively. The center and end height panels 6 and 8 create the height of the sleeve 1. The center height panel 6 is positioned between the upper panel 2 and the lower panel 4, and is connected to each via folds 10 and 12, respectively. The end height panel is connected to the lower panel 4 at fold 14.

In order to better maintain one or more thermal packs in place within the sleeve 1, sleeve 1 may include one or more pack assemblies. As illustrated in FIG. 1A, the sleeve 1 may include three pack assemblies, although embodiments are envisioned with fewer pack assemblies or more pack assemblies, as discussed below. The example embodiment shown in FIG. 1A includes two end pack assemblies 15 on either side of the sleeve 1. Each end assembly 15 may include a pack cover: left pack cover 16 and right pack cover 18. In addition to the two end pack assemblies 15, the example embodiment shown in FIG. 1A also includes a middle pack assembly 19. The middle pack assembly 19 may include a center pack cover 20.

Each end assembly 15 may also include a pack divider connected to one side of the respective pack cover: left pack divider 22 may extend toward the middle pack assembly 19 from left pack cover 16; and right pack divider 24 may extend toward the middle pack assembly 19 from right pack cover 18. The middle pack assembly may include two pack dividers 26 connected to opposing sides center pack cover 20 toward end pack assemblies 15. Further, a pack tab may further extend from each pack divider: left pack tab 28 may extend from left pack divider 22 toward the middle pack assembly 19; right pack tab 30 may extend from right pack divider 24 toward the middle pack assembly 19; and center pack tab 32 may extend from each center pack divider 26 in opposing directions toward each of the two end pack assemblies 15.

Left pack cover 16 may be connected to and extend from end height panel 8 at fold 34. Left pack divider 22 may extend from the left pack cover 16 at fold 36. Left pack tab 28 may extend from left pack divider 22 at fold 38. Similarly, right pack cover 18 may be connected to and extend from end height panel 8 at fold 40. Right pack divider 24 may extend from the right pack cover 18 at fold 42. Right pack tab 30 may extend from right pack divider 24 at fold 44. Center pack cover 20 may be connected to and extend from end height panel 8 at fold 46. Center pack dividers 26 may extend from the center pack cover 20 at folds 48 and 50. Center pack tabs 32 may extend from center pack dividers 26 at folds 52 and 54.

To form the sides of sleeve 1, the embodiment shown in FIG. 1A includes upper side panels 56. Each upper side panel 56 may have one or more upper side tabs 58 extending therefrom. As shown in FIG. 1, two upper side tabs 58 are shown extending from each upper side panel 56. It will be understood that this is merely one example and is not intended to be limiting. Upper side panels 56 may extend from either side of upper panel 2 at fold 60, and the one or more upper side tabs 58 may extend from the upper side panels 56 at folds 62.

Similarly, lower side panels 64 may extend from opposing sides of lower panel 4 at folds 65, and one or more lower side tabs 66 may extend from each lower side panel 64 at folds 67. As shown in FIG. 1, one lower side tab 66 is shown extending from each lower side panel 64. It will be understood that this is merely one example and is not intended to be limiting. One or more than one slot 68 may extend through sleeve 1 at the approximate position where fold 65 would extend if not for the presence of a slot 68. The positioning and number of the one or more than one slot 68 may coincide with the number and positioning of upper side tabs 58. Each slot 68 may be designed to receive an upper side tab 58 therewithin to help form the sleeve 1 when assembled. The use of tabs and slots discussed herein help to create structural support and rigidity without the use of tape or other adhesives to form the sleeve.

Additionally, one or more reinforcement tabs 78 may extend from height panels 6 and 8. As shown, reinforcement tabs 78 extend from opposing sides of each of the height panels 6 and 8 at folds 80. It will be understood that such reinforcement tabs 78 are optional, and if present, may be larger or smaller than as illustrated in FIG. 1A.

At least one front tab 70 may extend from upper panel 2 at fold 71. At least one middle tab 72 may also extend from upper panel 2 at fold 73. As shown in FIG. 1A, two front tabs 70 and one middle tab 72 are shown extending from upper panel 2. It will be understood that this is merely one example and is not intended to be limiting. As shown in FIG. 1A, two slots 74 may extend through sleeve 1, with one extending between folds 34 and 46, and another extending between folds 46 and 40. Additionally, a slot 76 may extend through sleeve 1 at the approximate position where fold 46 would continue to extend if not for the presence of the slot 76. The positioning and number of slots 74 and 76 may coincide with the number and positioning of front tabs 70 and middle tab 72. Each slot 74 may be designed to receive a front tab 70, and each slot 76 may be designed to receive a middle tab 72 therewithin to help form the sleeve 1 when assembled.

Figure 1B:
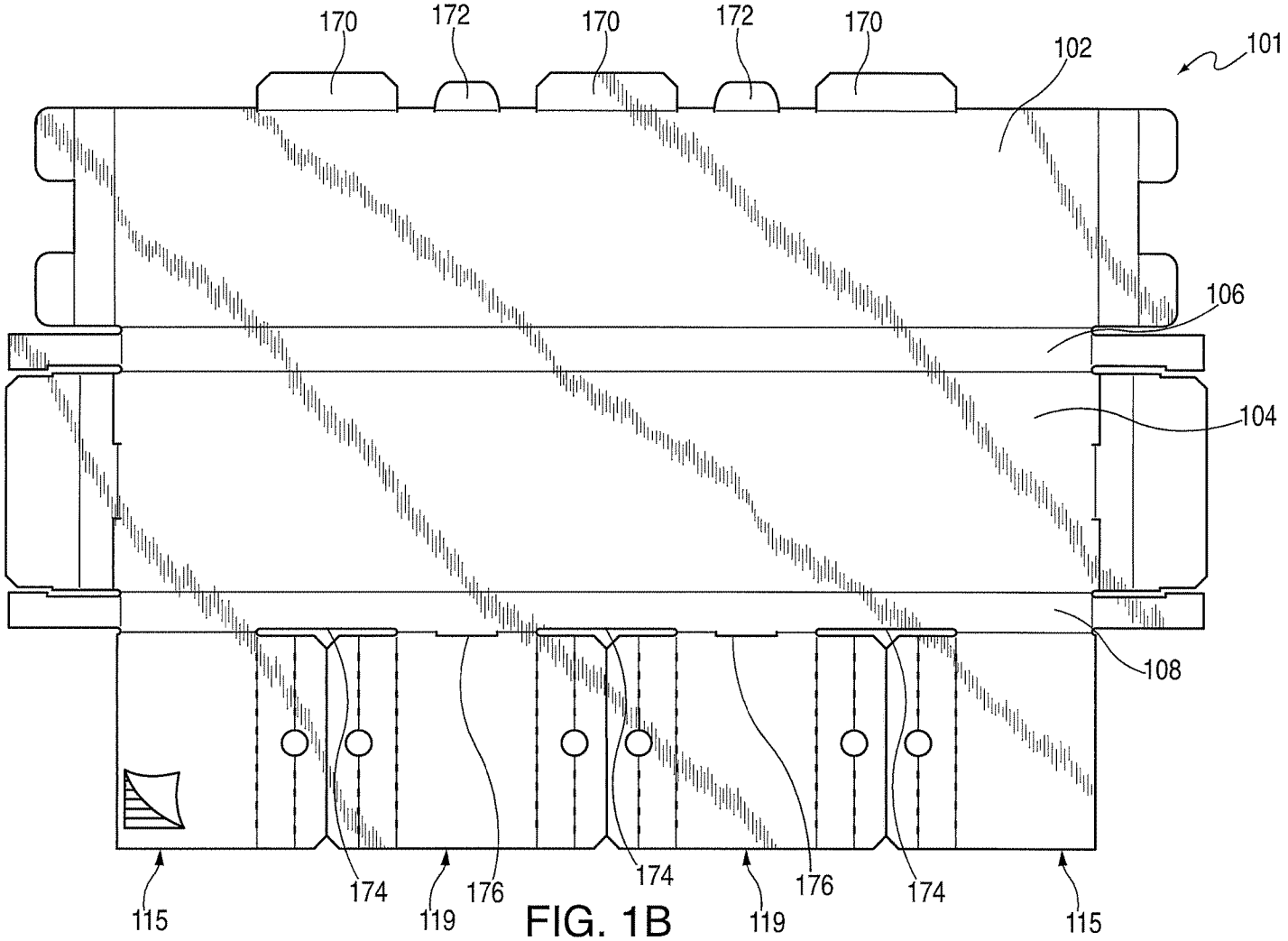
FIG. 1B illustrates another example embodiment of a sectioned corrugated sleeve for retaining seven thermal packs, in its unfolded state.

FIG. 1B illustrates a second example embodiment of a sleeve 101. Sleeve 101 is designed to retain seven thermal packs, whereas sleeve 101 in FIG. 1A is designed to retain five thermal packs. As noted above, sleeves could be designed to hold more or fewer thermal packs, as will be understood. Sleeve 101 in FIG. 1B will be described only in terms of differences from sleeve 1 in FIG. 1A. As will be seen, two end pack assemblies 115 extend from end height panel 108 just as in FIG. 1A. However, two middle pack assemblies 119 also extend from end height panel 108 rather than just one. Additionally, three front tabs 170 and two middle tabs 172 extend from upper panel 102 in FIG. 1B, rather than two front tabs 70 and one middle tab 72 in FIG. 1A. Similarly, three slots 174 and two slots 176 are available to receive the three front tabs 170 and two middle tabs 172, respectively.

Figure 2:
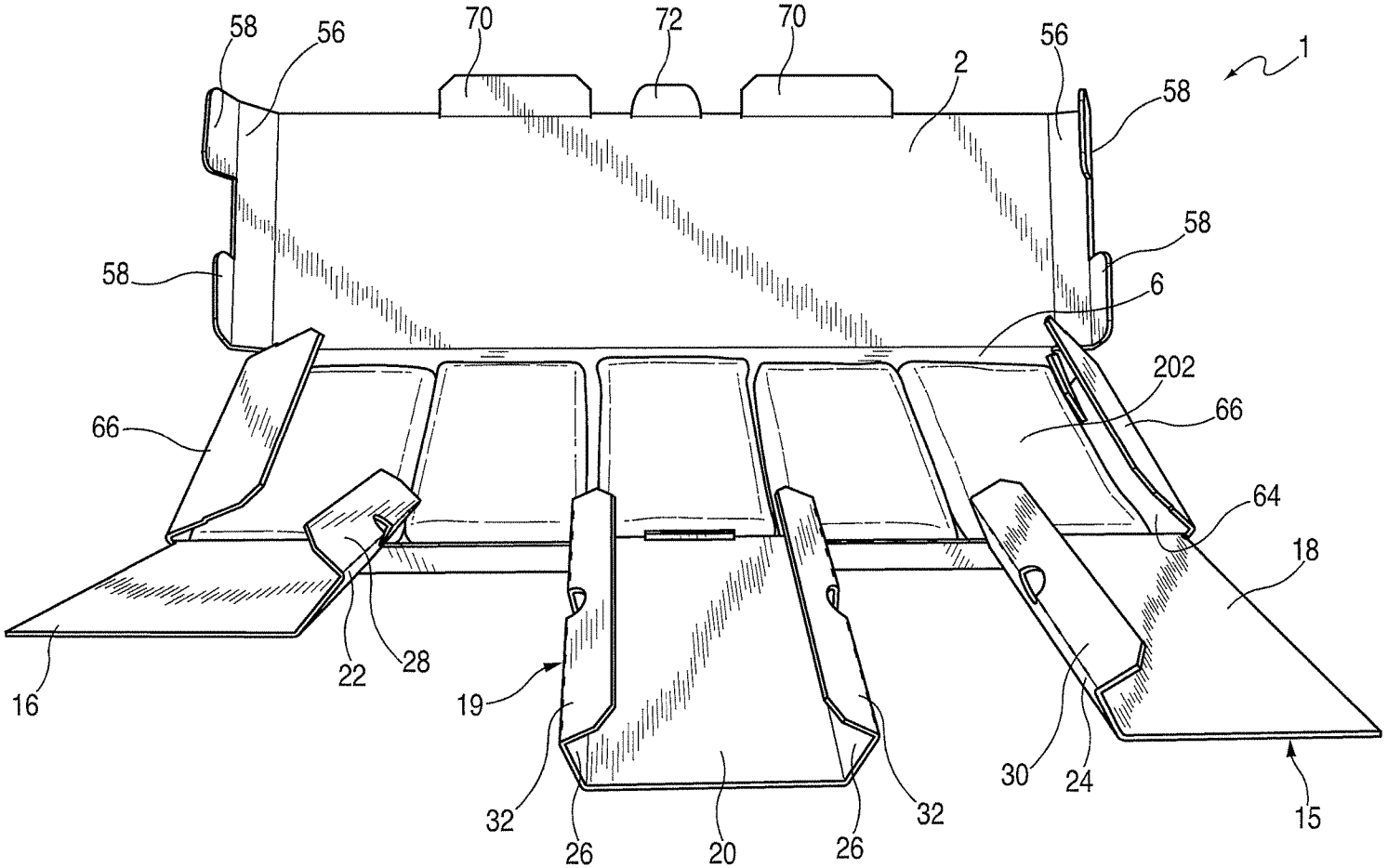
FIG. 2 illustrates the sleeve of FIG. 1A in a semi-formed state, with thermal packs placed therein.

FIG. 2 illustrates the sleeve 1 of FIG. 1A in a semi-formed state, with five thermal packs 202 placed therein. The height panels 6 and 8 have generally been folded to begin forming sides of sleeve 1. The end pack assemblies 15 and center pack assembly 19 have been folded generally into shape along fold lines 36, 38, 42, 44, 48, 50, 52, and 54. The upper side panels 56 and upper side tabs 58 have been generally folded into shape to eventually form the sides of sleeve 1. Lower side panels 64 and lower side tabs 66 have also been generally folded into shape to help form the sides of sleeve 1.

Figure 3:
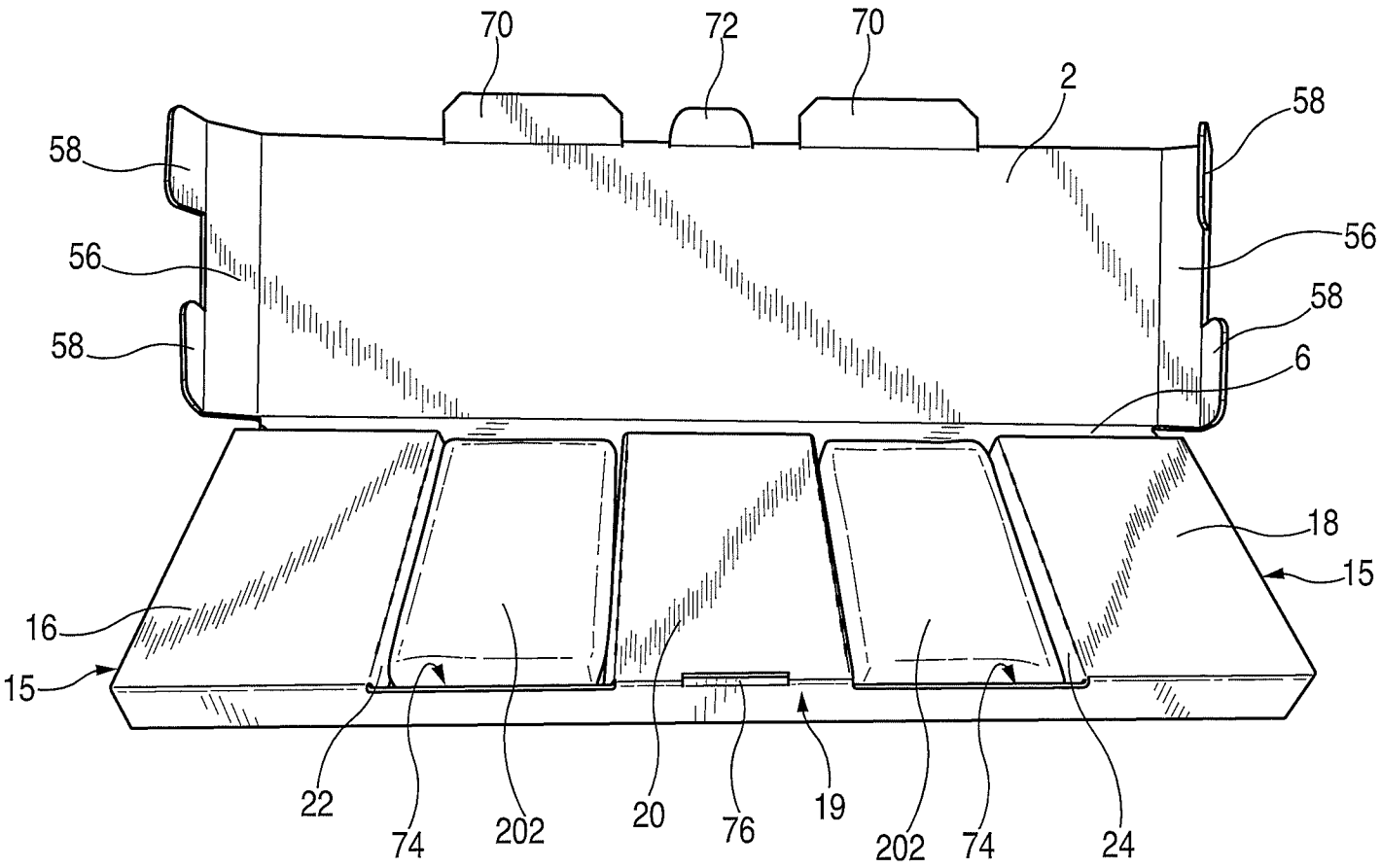
FIG. 3 illustrates the sleeve of FIG. 1A in a formed but open state, with thermal packs placed therein.

FIG. 3 illustrates the sleeve 1 of FIG. 1A in a formed but open state. As can be seen, end pack assemblies 15 and the middle pack assembly 19 have each been folded over on top of a thermal pack 202, leaving a single thermal pack in between each end pack assembly 15 and the middle pack assembly 19. The pack dividers 22, 24, and 26 respectively form barriers between adjacent thermal packs 202, and further help to reinforce the structure of sleeve 1. The pack tabs 28, 30, and 32 have been wrapped around respective thermal packs, and are positioned thereunder such that they are not visible in FIG. 3. Alternatively, the pack tabs 28, 30, and 32 may be folded outwardly so that they are positioned under adjacent thermal packs such that they would not be visible in FIG. 3. The lower side tabs 66 are also not visible in FIG. 3, because they are positioned between the end pack assemblies 15 and their respective thermal packs 202 at opposing ends of the sleeve 1 to provide additional support for thermal packs 202.

In order to fully close the sleeve 1, the upper panel 2 is folded overtop of the thermal packs 202. Front tabs 70 may be received within slots 74 (which may simply be formed as recesses between end height panel 8 and a thermal pad 202 along the fold 34 at specific locations), and middle tab 72 may be received within slot 76. Similarly, each upper side panels 56 may extend overtop of a respective lower side panel 64, and each upper side tab 58 may be received within a respective slot 68.

This structure may allow sleeve 1 to be secured in a closed configuration without the use of tape. Further, the pack assemblies 15 and 19 may both retain thermal packs 202 in place to prevent shifting, as well as provide general structural reinforcement to sleeve 1. Waterproof adhesives may be used with corrugated cardboard, as would be understood in the art, to help prevent damage to the sleeve 1 which could be caused by condensation forming on the thermal packs 202.

As was mentioned above and as will be understood, structures for more or fewer packs thermal packs are also envisioned. The structure for seven thermal packs described hereinabove includes two end pack assemblies and two middle pack assemblies. The structure for five thermal packs described hereinabove includes two end pack assemblies and one middle pack assembly. As a person having ordinary skill in the art would understand, a structure for three thermal packs may have substantially the same structure, but with two end pack assemblies and one middle pack assembly. Alternatively, one middle pack assembly and no end pack assemblies could be used. Similarly, a structure for nine thermal packs may have substantially the same structure, but with two end pack assemblies and three middle pack assemblies. Structures for larger numbers of thermal packs would follow a similar pattern.

As a non-limiting example, the number of pack assemblies may be [(N−1)/2] (where N is the number of thermal packs housed by the corrugated sleeve). In this case, N is an odd integer ≥3. Further, in this example scenario, each pack assembly would be a middle pack assembly. In another non-limiting example, the number of pack assemblies may be [(N+1)/2], where N is again the number of thermal packs housed by the corrugated sleeve, and N is an odd integer ≥3. In this second example scenario, two of the N pack assemblies would be end pack assemblies, and (N−2) of the pack assemblies would be middle pack assemblies.

Thus, there has been shown and described several embodiments of a novel sectioned corrugated sleeve. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A corrugated sleeve comprising:

an upper panel forming a top of the sleeve;

a lower panel forming a bottom of the sleeve;

at least two height panels forming a front and back of the sleeve, respectively;

at least two side panels forming a left and right of the sleeve, respectively, wherein said upper, lower, height, and side panels forming external structure of the sleeve;

at least one pack assembly extending from one of said panels, said at least one pack assembly comprising a middle pack assembly including a center pack cover having opposing sides, two pack dividers, wherein one pack divider extends from each of the opposing sides of the center pack cover, said pack dividers being positioned between adjacent thermal packs when such thermal packs are contained within the sleeve, and at least two center pack tabs, wherein one center pack tab extends from each pack divider in opposing directions.

2. The corrugated sleeve of claim 1 wherein:

said upper panel extends from a top side of said back height panel;

said lower panel extends from a bottom side of said back height panel;

said front height panel extends from a side of said lower panel opposite said back height panel;

said side panels extending from opposing left and right sides at least one of said upper and lower panels; and wherein said at least one pack assembly extending from a side of said front height panel opposite said lower panel.

3. The corrugated sleeve of claim 1 wherein said at least one pack assembly includes two end pack assemblies.

4. The corrugated sleeve of claim 3 wherein each said end pack assembly includes:

an end pack cover having opposing sides, wherein the end pack cover extends from the front height panel;

a pack divider connected to one side of the end pack cover opposite the front height panel; and an end pack tab extending from the pack divider opposite the end pack cover.

5. The corrugated sleeve of claim 4 wherein at least one tab extends from said upper panel opposite the back height panel, wherein said at least one tab is sized to be received within a gap between said front height panel on one side and said pack divider and end pack tab on another side.

6. The corrugated sleeve of claim 1 wherein the number of pack assemblies is [(N−1)/2], where N is the number of thermal packs housed by said corrugated sleeve, and N is an odd integer ≥3.

7. The corrugated sleeve of claim 6 wherein each pack assembly is a middle pack assembly.

8. The corrugated sleeve of claim 1 wherein the number of pack assemblies is [(N+1)/2], where N is the number of thermal packs housed by said corrugated sleeve, and N is an odd integer ≥3.

9. The corrugated sleeve of claim 8 wherein two of said N pack assemblies are end pack assemblies, and (N−2) of said pack assemblies are middle pack assemblies.

10. A corrugated sleeve comprising:

an upper panel forming a top of the sleeve;

a lower panel forming a bottom of the sleeve;

at least two height panels forming a front and back of the sleeve, respectively;

at least two side panels forming a left and right of the sleeve, respectively, wherein said upper, lower, height, and side panels forming external structure of the sleeve;

at least one pack assembly extending from one of said panels, said at least one pack assembly including two end pack assemblies, each end pack including an end pack cover having opposing sides, wherein the end pack cover extends from the front height panel, a pack divider connected to one side of the end pack cover opposite the front height panel, said pack divider being positioned between adjacent thermal packs when such thermal packs are contained within the sleeve, and an end pack tab extending from the pack divider opposite the end pack cover, wherein at least one tab extends from said upper panel opposite the back height panel, wherein said at least one tab is sized to be received within a gap between said front height panel on one side and said pack divider and end pack tab on another side.

11. The corrugated sleeve of claim 10 wherein:

said upper panel extends from a top side of said back height panel;

said lower panel extends from a bottom side of said back height panel;

said front height panel extends from a side of said lower panel opposite said back height panel;

said side panels extending from opposing left and right sides at least one of said upper and lower panels; and wherein said at least one pack assembly extending from a side of said front height panel opposite said lower panel.

12. The corrugated sleeve of claim 10 wherein said at least one pack assembly comprises a middle pack assembly.

13. The corrugated sleeve of claim 12 wherein said middle pack assembly includes:

a center pack cover having opposing sides;

two pack dividers, wherein one pack divider extends from each of the opposing sides of the center pack cover; and at least two center pack tabs, wherein one center pack tab extends from each pack divider in opposing directions.

14. The corrugated sleeve of claim 10 wherein the number of pack assemblies is [(N−1)/2], where N is the number of thermal packs housed by said corrugated sleeve, and N is an odd integer ≥3.

15. The corrugated sleeve of claim 14 wherein each pack assembly is a middle pack assembly.

16. The corrugated sleeve of claim 10 wherein the number of pack assemblies is [(N+1)/2], where N is the number of thermal packs housed by said corrugated sleeve, and N is an odd integer ≥3.

17. The corrugated sleeve of claim 16 wherein two of said N pack assemblies are end pack assemblies, and (N−2) of said pack assemblies are middle pack assemblies.

* * * * *